US011661864B2

(12) United States Patent
Shinkawa et al.

(10) Patent No.: US 11,661,864 B2
(45) Date of Patent: May 30, 2023

(54) TURBINE CASING, GAS TURBINE, AND ALIGNING METHOD

(71) Applicant: MITSUBISHI HEAVY INDUSTRIES, LTD., Tokyo (JP)

(72) Inventors: Toru Shinkawa, Tokyo (JP); Shosaku Hiwatashi, Tokyo (JP); Daiki Hirokawa, Tokyo (JP); Yasuyuki Watanabe, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/826,537

(22) Filed: May 27, 2022

(65) Prior Publication Data

US 2023/0066823 A1 Mar. 2, 2023

(30) Foreign Application Priority Data

Jun. 4, 2021 (JP) ..... JP2021-094536

(51) Int. Cl.
*F01D 25/24* (2006.01)
*F01D 25/26* (2006.01)

(52) U.S. Cl.
CPC ..... *F01D 25/243* (2013.01); *F01D 25/265* (2013.01); *F05D 2220/32* (2013.01); *F05D 2230/60* (2013.01); *F05D 2240/14* (2013.01)

(58) Field of Classification Search
CPC .. F01D 25/243; F01D 25/265; F05D 2220/32; F05D 2230/60; F05D 2240/14
See application file for complete search history.

(56) References Cited

U.S. PATENT DOCUMENTS 3,493,212 A * 2/1970 Scalzo ..... F01D 25/285 415/127
3,741,680 A * 6/1973 Killmann ..... F01D 25/265 415/214.1
2012/0272496 A1* 11/2012 Herbold ..... B66C 1/107 29/402.03
2013/0230392 A1 9/2013 Hashimoto

FOREIGN PATENT DOCUMENTS

JP 2013-181503 9/2013

* cited by examiner

*Primary Examiner* — Eldon T Brockman
(74) *Attorney, Agent, or Firm* — Wenderoth, Lind & Ponack, L.L.P.

(57) ABSTRACT

A turbine casing divided in an axial direction into a first casing and a second casing coupled to each other by flanges of the first casing and the second casing. The first casing and the second casing are divided into two parts as viewed from the axial direction, the two parts being an upper half casing and a lower half casing. The turbine casing having three or more sets of a first radial reference surface and a second radial reference surface in a circumferential direction, the first radial reference surface being disposed in a flange peripheral portion of the first casing, and the second radial reference surface being disposed in a flange peripheral portion of the second casing. Each first radial reference surface is located at an equal distance from a turbine central axis. Each second radial reference surface is located at an equal distance from the turbine central axis.

8 Claims, 3 Drawing Sheets

TURBINE CASING, GAS TURBINE, AND ALIGNING METHOD

BACKGROUND OF THE INVENTION

1. Field of the Invention

The present invention relates to a turbine casing, a gas turbine, and an aligning method.

2. Description of the Related Art

A gas turbine, for example, includes: a compressor that generates compressed air; a combustor that generates combustion gas by mixing a fuel with the compressed air and combusting the fuel; and a turbine driven by the combustion gas. A turbine casing constituting the contour of the gas turbine is generally divided into a plurality of parts in an axial direction (JP-2013-181503-A).

PRIOR ART DOCUMENT

Patent Document

Patent Document 1

JP-2013-181503-A

SUMMARY OF THE INVENTION

When the gas turbine is assembled, piece-part assembly of only the turbine casing is performed before final assembly performed by internally incorporating a rotor. In a step of this piece-part assembly, axial alignment (centering) of each part is performed in a state in which the turbine casing is erected vertically. In work of the axial alignment, an alignment jig having a dial gage attached to an arm that swings around a pole may be used. Specifically, the parts are placed so as to cover the pole, distances between the pole and the inner circumferential surfaces of the parts are measured by the dial gage by swinging the arm around the pole, and the positions of the parts are adjusted in a horizontal direction such that all the circumferences of the inner circumferential surfaces are at equal distances from the pole. The axes of the parts are aligned with each other with the pole as a reference by performing such work for all of the stacked parts as needed.

However, this work takes time, and the dedicated alignment jig needs to be prepared.

It is an object of the present invention to provide a turbine casing, a gas turbine, and an aligning method that obviate a need for a dedicated alignment jig, and make it possible to shorten the time of piece-part assembly.

In order to achieve the above object, according to the present invention, there is provided a turbine casing divided in an axial direction into a first casing and a second casing coupled to each other by flanges of the first casing and the second casing, the first casing and the second casing each being divided into two parts as viewed from the axial direction, the two parts being an upper half casing and a lower half casing, the turbine casing having three or more sets of a first radial reference surface and a second radial reference surface in a circumferential direction, the first radial reference surface being disposed in a flange peripheral portion of the first casing the second radial reference surface being disposed in a flange peripheral portion of the second casing, each first radial reference surface being located at an equal distance from a turbine central axis, each second radial reference surface being located at an equal distance from the turbine central axis, positional relation between the first radial reference surface and the second radial reference surface being equal in each set.

According to the present invention, it is possible to obviate a need for a dedicated alignment jig, and shorten the time of piece-part assembly.

DESCRIPTION OF THE PREFERRED EMBODIMENTS

An embodiment of the present invention will hereinafter be described with reference to the drawings.

Gas Turbine

Figure 1:
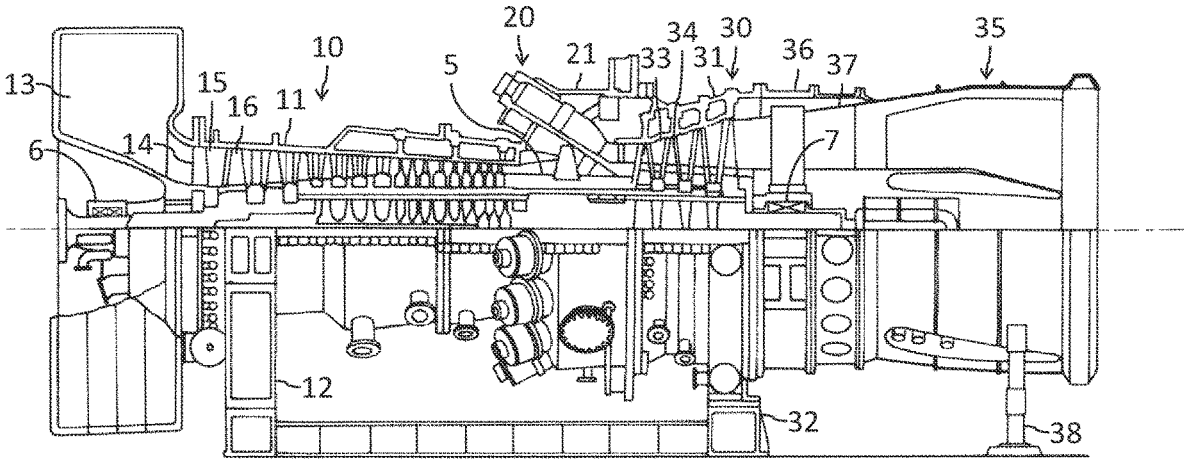
FIG. 1 is a schematic configuration diagram of an example of a gas turbine according to one embodiment of the present invention.

FIG. 1 is a schematic configuration diagram of an example of a gas turbine according to one embodiment of the present invention. The gas turbine shown in the figure is a prime mover that drives a load apparatus (not shown). The gas turbine includes a compressor 10, combustors 20, a turbine 30, and an exhaust chamber 35. A casing of the compressor 10 (compressor casing 11) is supported by a leg portion 12. A casing of the turbine 30 (turbine casing 31) is supported by a leg portion 32. The exhaust chamber 35 is supported by a leg portion 38. The load apparatus is typically a generator. However, a pump may be applied as the load apparatus. Incidentally, when the gas turbine is referred to as a "gas turbine engine," the turbine may be referred to as a "gas turbine."

The compressor 10 has an air intake 13 for taking in air and an inlet guide vane (IGV) 14 within the compressor casing 11. The compressor 10 further includes a stage portion in which stator blades 15 and rotor blades 16 are arranged alternately in the direction of the central axis of the turbine in the rear of the inlet guide vane 14. The combustors 20 are plurally arranged annularly on a peripheral portion of a combustor casing 21 between the compressor 10 and the turbine 30. The turbine 30 includes, within the turbine casing 31, stator blades 33 and rotor blades 34 arranged alternately in the direction of the central axis of the turbine. On a downstream side of the turbine casing 31, the exhaust chamber 35 is disposed via an exhaust casing 36. The exhaust chamber 35 has an exhaust diffuser 37 continuous with the turbine 30.

In addition, a rotor 5 is located so as to pass through the centers of the compressor 10, the combustors 20, the turbine 30, and the exhaust chamber 35. An end portion of the rotor 5, which is on the compressor 10 side, is rotatably supported by a bearing 6. An end portion of the rotor 5, which is on the exhaust chamber 35 side, is rotatably supported by a bearing 7. A part of the rotor 5, which belongs to the compressor 10, is formed by superposing, in an axial direction, a plurality of disks having a plurality of rotor blades 16 fitted to peripheral portions thereof. A part of the rotor 5, which belongs to the turbine 30, is formed by superposing, in the axial direction, a plurality of disks having a plurality of rotor blades 34 fitted to peripheral portions thereof. In the example of FIG. 1, the end portion of the rotor 5, which is on the exhaust chamber 35 side, is coupled as an output power shaft to a driving shaft of a load apparatus (not shown).

In the above constitution, air taken into the compressor 10 from the air intake 13 is compressed while passing through the inlet guide vane 14, the cascade of the stator blades 15, and the cascade of the rotor blades 16, so that a high-temperature and high-pressure compressed air is generated. In the combustors 20, a fuel supplied from a fuel system is mixed and combusted with the compressed air supplied from the compressor 10. A high-temperature combustion gas is thereby generated, and is supplied to the turbine 30. A liquid fuel or a gaseous fuel is used as the fuel. The high-temperature and high-pressure combustion gas as an operating fluid generated in the combustors 20 passes through the cascade of the stator blades 33 and the cascade of the rotor blades 34 in the turbine 30, and thereby drives and rotates the rotor 5. A part of the output power of the turbine 30 is used as power to the compressor 10. The rest of the output power of the turbine 30 is used as power to the load apparatus 4. The combustion gas that has driven the turbine 30 is discharged as exhaust gas via the exhaust chamber 35. In the present embodiment, a single-shaft gas turbine is illustrated. However, application targets of the invention include a two-shaft gas turbine. The two-shaft gas turbine includes a high pressure turbine and a low pressure turbine having rotary shafts separated from each other, and has a configuration in which the high pressure turbine is coaxially coupled to the compressor, and the low pressure turbine is coaxially coupled to the turbine.

Turbine Casing

The above-described gas turbine is provided with a turbine casing that includes the rotor 5. The turbine casing is divided in the direction of the central axis of the turbine into divided casings as a plurality of cylindrical parts, specifically the compressor casing 11, the combustor casing 21, the turbine casing 31, the exhaust casing 36, and the like. The compressor casing 11 and the combustor casing 21 have vertical annular flanges (for example, flanges 21*v* and 31*v* to be described later with reference to FIG. 2 or the like) in mutually opposed portions thereof. The compressor casing 11 and the combustor casing 21 are coupled to each other by fastening these flanges with bolts (not shown). The same is true for the combustor casing 21 and the turbine casing 31. The same is true for the turbine casing 31 and the exhaust casing 36. In addition, the number of divisions in the axial direction of the turbine casing can be changed.

Further, the parts of the turbine casing such as the compressor casing 11, the combustor casing 21, the turbine casing 31, and the exhaust casing 36 are each divided into two parts, that is, an upper half casing and a lower half casing as viewed from the axial direction. Each upper half casing and the lower half casing corresponding to the upper half casing include horizontally extending flanges (for example, flanges 21*hl*, 21*h*2, 31*hl*, and 31*h*2 to be described later with reference to FIG. 2) in mutually opposed portions thereof. The upper half casing and the lower half casing are coupled to each other by fastening these flanges with a large number of bolts (not shown).

Alignment Structure

Figure 2:
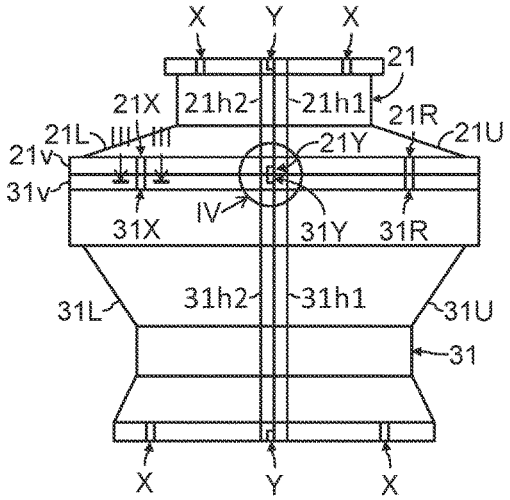
FIG. 2 is a diagram extracting and showing a first casing and a second casing constituting a turbine casing of the gas turbine according to one embodiment of the present invention.
Figure 3:
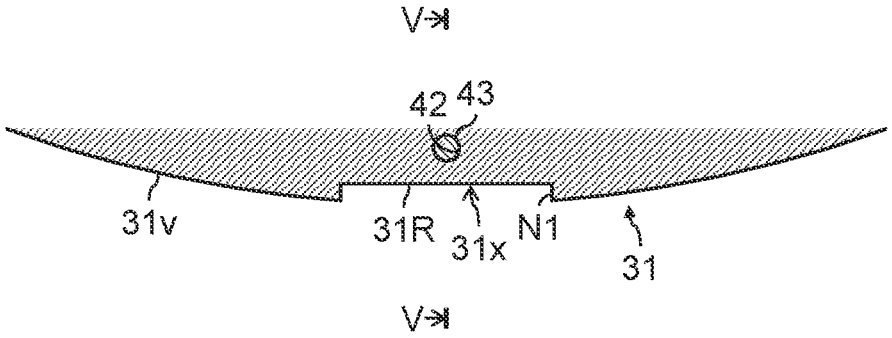
FIG. 3 is a sectional view taken along a line III-III in FIG. 2.
Figure 4:
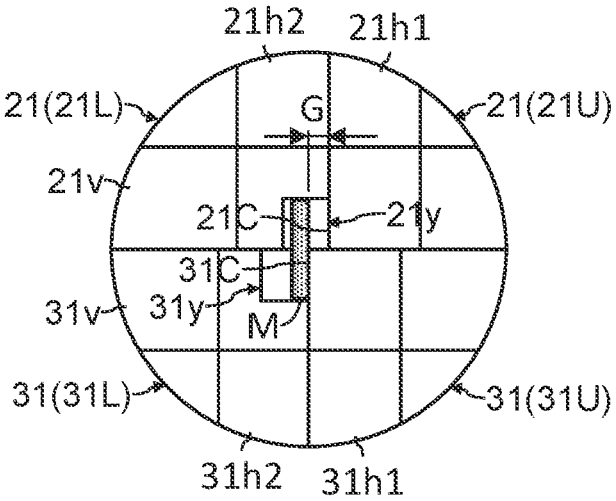
FIG. 4 is an enlarged view of a part indicated by an arrow IV in FIG. 2.
Figure 5:
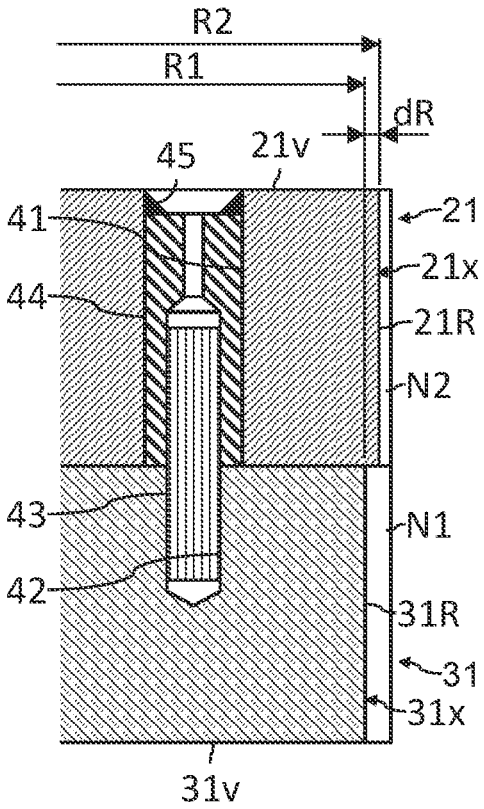
FIG. 5 is a sectional view taken along a line V-V in FIG. 3.

FIG. 2 is a diagram extracting and illustrating a first casing and a second casing constituting the turbine casing. FIG. 3 is a sectional view taken along a line III-III in FIG. 2. FIG. 4 is an enlarged view of a part indicated by an arrow IV in FIG. 2. FIG. 5 is a sectional view taken along a line V-V in FIG. 3. In the assembly of the gas turbine, piece-part assembly of the turbine casing is performed before final assembly performed by assembling the rotor 5 (FIG. 1) into the turbine casing. FIGS. 2 to 5 represent a mode at a time of alignment between the first casing and the second casing, which is performed in the piece-part assembly of the turbine casing. Specifically, FIGS. 2 to 5 show a state in which the second casing is stacked on the first casing with the turbine central axis set vertical.

In the specification of the present application, parts (divided casings) of the turbine casing, which are mutually coupled by flanges so as to be adjacent to each other in the axial direction of the turbine, will be described as the first casing and the second casing as appropriate. FIG. 2 illustrates the turbine casing 31 and the combustor casing 21 as the first casing and the second casing. In addition, the exhaust casing 36 and the turbine casing 31 as well as the combustor casing 21 and the compressor casing 11 correspond to the first casing and the second casing. In addition, the objects of the first casing and the second casing may be opposite from each other.

The turbine casing is provided with three or more sets (four sets in the present example) of radial reference surfaces at intervals in a circumferential direction in the opposed portions of the first casing (turbine casing 31 in this case) and the second casing (combustor casing 21). Each set of radial reference surfaces includes a first radial reference surface 31R (FIG. 3 and FIG. 5) provided in a peripheral portion of a flange 31*v* of the turbine casing 31 and a second radial reference surface 21R (FIG. 5) provided in a peripheral portion of a flange 21*v* of the combustor casing 21.

Each of the first radial reference surfaces 31R is located at an equal distance from the turbine central axis (at a position at a distance R1 from the turbine central axis). In addition, each first radial reference surface 31R is constituted by a surface parallel with the turbine central axis and facing outward in a radial direction of the turbine casing 31 among inner wall surfaces of a flat groove-shaped slit 31*x* provided in the peripheral portion of the flange 31*v* of the turbine casing 31. In the present embodiment, a flat surface is adopted as the first radial reference surface 31R, and as viewed in the direction of the turbine central axis, the first radial reference surface 31R is orthogonal to a plane including the turbine central axis at the position at the distance R1 from the turbine central axis. That is, each of the first radial reference surfaces 31R constitutes a tangent to a same circle having the turbine central axis as a center as viewed in the direction of the turbine central axis. However, the first radial reference surface 31R does not need to be a flat surface as long as the first radial reference surface 31R is in predetermined positional relation to the second radial reference surface 21R. For example, the first radial reference surface 31R may be a curved surface.

Each of the second radial reference surfaces 21R is located at an equal distance from the turbine central axis (at a position at a distance R2 from the turbine central axis). In addition, each second radial reference surface 21R is constituted by a surface parallel with the turbine central axis and facing outward in a radial direction of the combustor casing 21 among inner wall surfaces of a flat groove-shaped slit 21*x* provided in the peripheral portion of the flange 21*v* of the combustor casing 21. In the present embodiment, a flat surface is adopted as the second radial reference surface 21R, and as viewed in the direction of the turbine central axis, the second radial reference surface 21R is orthogonal to a plane including the turbine central axis at the position at the distance R2 from the turbine central axis. That is, each of the second radial reference surfaces 21R constitutes a tangent to a same circle having the turbine central axis as a center as viewed in the direction of the turbine central axis. However, the second radial reference surface 21R does not need to be a flat surface as long as the second radial reference surface 21R is in predetermined positional relation to the first radial reference surface 31R. For example, the second radial reference surface 21R may be a curved surface.

The positional relation between the first radial reference surface 31R and the second radial reference surface 21R is equal in each set of the first and second reference surfaces. While the first radial reference surface 31R and the second radial reference surface 21R may be flush with each other (that is, R1=R2), it suffices for the mutual positional relation to be equal in each set, and the first radial reference surface 31R and the second radial reference surface 21R do not necessarily need to be flush with each other. FIG. 5 illustrates a case where the second radial reference surface 21R is more distant from the turbine central axis by a distance dR than the first radial reference surface 31R, and there is a step between the radial reference surfaces 31R and 21R.

In addition, as shown in FIG. 4, the turbine casing is provided with at least one set of groove-shaped notches 31*y* and 21*y* (two sets at a pitch of 180° in the present example) in the opposed portions of the first casing (turbine casing 31) and the second casing (combustor casing 21).

The notch 31*y* is provided on one side of the upper half casing 31U and the lower half casing 31L (lower half casing 31L in FIG. 4) of the turbine casing 31 so as to face the other side (upper half casing 31U). That is, the notch 31*y* is provided at a corner part at which end surfaces of the flanges 31*v* and 31*h*2 of the turbine casing 31 intersect each other. A surface of the upper half casing 31U, which is opposed to the lower half casing 31L (that is, an end surface of the flange 31*h*1 of the upper half casing 31U), is partly exposed to face the notch 31*y*. The end surface of the flange 31*h*1, which faces the notch 31*y*, constitutes a first roll reference surface 31C for alignment in the circumferential direction between the turbine casing 31 and the combustor casing 21. Hence, the first roll reference surface 31C corresponds to a section of the flange 31*v* among end surface portions of the flange 31*hl* of the upper half casing 31U of the turbine casing 31.

The notch 21*y* is provided on one side of the upper half casing 21U and the lower half casing 21L (lower half casing 21L in the present example) of the combustor casing 21 so as to face the other side (upper half casing 21U). That is, the notch 21*y* is provided at a corner part at which end surfaces of the flanges 21*v* and 21*h*2 of the combustor casing 21 intersect each other. The circumferential positions of the notches 21*y* and 31*y* correspond to each other, and the notches 21*y* and 31*y* face each other in the direction of the turbine central axis. In addition, a surface of the upper half casing 21U, which is opposed to the lower half casing 21L (that is, an end surface of the flange 21*h*1 of the upper half casing 21U), is partly exposed to face the notch 21*y*. The end surface of the flange 21*hl*, which faces the notch 21*y*, constitutes a second roll reference surface 21C for alignment in the circumferential direction between the turbine casing 31 and the combustor casing 21. Hence, the second roll reference surface 21C corresponds to a section of the flange 21*v* among end surfaces of the flange 21*hl* of the upper half casing 21U of the combustor casing 21.

The first roll reference surface 31C and the second roll reference surface 21C are both the end surfaces of the upper half casings 31U and 21U opposed to the lower half casings 31L and 21L. The circumferential positions of the first roll reference surface 31C and the second roll reference surface 21C therefore coincide with each other with high accuracy in a state in which the turbine casing is assembled. The width dimensions in the circumferential direction of the notches 31*y* and 21*y* may be made to coincide with each other, but do not necessarily need to coincide with each other.

In addition, as shown in FIG. 5, the flange 21*v* of the second casing (combustor casing 21) is provided with a through hole 41 parallel with the turbine central axis. In addition, an end surface of the flange 31*v* of the first casing (turbine casing 31) is provided with a knock hole 42 corresponding in position to the through hole 41. The knock hole 42 is a pin hole for inserting a knock pin 43. A dimensional tolerance between the outside diameter of the knock pin 43 and the inside diameter of the knock hole 42 is set as small as possible, and there is practically no clearance between the outer circumferential surface of the knock pin 43 and the inner circumferential surface of the knock hole 42. The knock pin 43 is partly inserted into the knock hole 42 of the flange 31*v* of the turbine casing 31 through the through hole 41. A remaining part of the knock pin 43, which projects from the knock hole 42, is located within the through hole 41. In addition, a bush 44 is located within the through hole 41.

The bush 44 is a cylindrical member, and functions as a spacer fitted so as to cover the knock pin 43 and filling a clearance between the knock pin 43 and the through hole 41. A dimensional tolerance between the outside diameter of the knock pin 43 and the inside diameter of the bush 44 is set as small as possible, and there is practically no clearance between the outer circumferential surface of the knock pin 43 and the inner circumferential surface of the bush 44. On the other hand, though not shown in the schematic diagram of FIG. 5, the inside diameter of the through hole 41 is set slightly larger than the outside diameter of the bush 44, and thus there is a predetermined clearance between the inner circumferential surface of the through hole 41 and the outer circumferential surface of the bush 44. The bush 44 is fixed to the flange 21*v* of the combustor casing 21 (for example, the inner wall of the through hole 41) by welding (welding portion 45) in a state in which the bush 44 is fitted to the knock pin 43. Consequently, the knock pin 43 is constrained by the knock hole 42, the bush 44 is constrained by the knock pin 43, and the through hole 41 is constrained by the bush 44, so that the flanges 31*v* and 21*v* constrain each other.

Incidentally, while description has been made with reference to FIGS. 2 to 5 by taking the configuration of the opposed portions of the turbine casing 31 and the combustor casing 21 as an example, the structures of the radial reference surfaces, the roll reference surfaces, the knock pin, and the like are similarly provided also to the opposed portions of the other first and second casings. For reference, FIG. 2 illustrates radial reference surfaces X and roll reference surfaces Y.

Turbine Casing Aligning Method

Referring to FIGS. 2 to 5, description will be made of a step of axial alignment and angular alignment between the first casing and the second casing adjacent to each other in the axial direction, the axial alignment and the angular alignment being performed in a process of the piece-part assembly of the turbine casing. In performing this step, the upper half casing 31U and the lower half casing 31L of the turbine casing 31 are coupled to each other and formed into a cylindrical shape in advance. The same is true for the upper half casing 21U and the lower half casing 21L of the combustor casing 21. The turbine casing 31 and the combustor casing 21 are provided in advance with the first radial reference surfaces 31R, the second radial reference surfaces 21R, the first roll reference surfaces 31C, and the second roll reference surfaces 21C described earlier.

The inside diameter of the turbine casing 31 is, for example, machined (turned) by a machining center, for example, in a state in which the turbine casing 31 is in a cylindrical shape. At this time, the first radial reference surfaces 31R (slits 31*x*) are formed in advance by, for example, milling or the like at the same time (by one time of setup work). When each first radial reference surface 31R is formed in the same setup as the inside diameter machining, all of the first radial reference surfaces 31R can be formed at equal distances from the turbine central axis with high accuracy. The notch 31*y* related to the first roll reference surface 31C and the knock hole 42 may be also formed at the time of the inside diameter machining of the turbine casing 31. However, the notch 31*y* and the knock hole 42 do not need a high position accuracy, and therefore may be machined in another step.

Similarly, when the inside diameter of the combustor casing 21 is machined (turned), the second radial reference surfaces 21R (slits 21*x*) are formed in advance by, for example, milling or the like at the same time (by one time of setup work). When the second radial reference surfaces 21R are formed in the same setup as the inside diameter machining, all of the second radial reference surfaces 21R can be formed at equal distances from the turbine central axis with high accuracy. The notch 21*y* related to the second roll reference surface 21C and the through hole 41 may be also formed at the time of the inside diameter machining of the combustor casing 21. However, the notch 21*y* and the through hole 41 do not need a high position accuracy, and therefore may be machined in another step.

At a time of the piece-part assembly of the turbine casing, alignment (axial alignment and angular alignment) is performed between the turbine casing 31 and the combustor casing 21 thus fabricated separately. On a horizontal disk surface, for example, the combustor casing 21 is placed on the turbine casing 31 by using a crane, for example, such that the flanges 31*v* and 21*v* of the turbine casing 31 and the combustor casing 21 face each other in a posture in which the turbine central axis is oriented vertically. When the combustor casing 21 is stacked on the turbine casing 31, the circumferential positions of the slits 31*x* and 21*x* and the notches 31*y* and 21*y* are made to roughly coincide with each other in advance.

Next, steps of axial alignment and angular alignment of the combustor casing 21 with respect to the turbine casing 31 are performed. These axial alignment and angular alignment steps are performed in succession or in parallel with each other, and at a time of the axial alignment, the work of the angular alignment is also performed. When the steps of the axial alignment and the angular alignment are performed in succession, either step may be performed first. When necessary, the work of the axial alignment and the angular alignment may be repeated alternately multiple times.

Description will first be made of the step of the angular alignment of the combustor casing 21 with respect to the turbine casing 31. In the step of the angular alignment, while the combustor casing 21 is pulled upward by a crane or the like, the positions in the circumferential direction of the turbine casing 31 and the combustor casing 21 are made to coincide with each other by, for example, manually rotating (rolling) the combustor casing 21 about the central axis. The circumferential positions of the first roll reference surface 31C and the second roll reference surface 21C are made to coincide with each other by thus finely adjusting the angle of the combustor casing 21. As one method at the time, for example, a contact fitting M (FIG. 4) is made to abut against the roll reference surface 31C or 21C (roll reference surface 31C in the example of FIG. 4) within the notches 31*y* and 21*y*. Then, a clearance G between the contact fitting M and the roll reference surface 21C or 31C (roll reference surface 21C in the example of FIG. 4) is measured by a scale, a clearance gage, or the like, and the combustor casing 21 is moved such that the clearance G becomes zero. The angle of the combustor casing 21 with respect to the turbine casing 31 can be thereby adjusted.

Next, the step of the axial alignment will be described. Also in the step of the axial alignment, as in the step of the angular alignment, while the combustor casing 21 is pulled upward by a crane, the center of the combustor casing 21 is made to coincide with the center of the turbine casing 31 by, for example, manually moving (shifting) the combustor casing 21 in a horizontal direction. The positional relations between the first radial reference surfaces 31R and the second radial reference surfaces 21R are made to be equal at all positions in the circumferential direction by thus finely adjusting the position in the horizontal direction of the combustor casing 21. Specifically, step dimensions between the first radial reference surfaces 31R and the second radial reference surfaces 21R are measured as the positional relations between the first radial reference surfaces 31R and the second radial reference surfaces 21R by a measuring instrument such as a dial gage or the like, and the steps are made to be equal at all of the positions in the circumferential direction. That is, the steps between the first radial reference surfaces 31R and the second radial reference surfaces 21R are all made to be a value within an allowable value set in advance for the distance dR (FIG. 5).

At this time, when the width dimension of the slit 31*x* or 21*x* is adjusted to the width of a magnet base retaining the dial gage, for example, a point to be measured by the dial gage is positioned easily by setting the magnet base in the slit 31*x* or 21*x*. Efficiency of axial alignment work is improved when the dial gage is thus installed at each position in the circumferential direction, and the position of the combustor casing 21 is adjusted while the measured value of each dial gage is viewed.

Effects (1) As described above, three or more sets of first radial reference surfaces 31R and second radial reference surfaces 21R are provided in the circumferential direction to align the axes of the first casing and the second casing adjacent to each other in the axial direction. All of the first radial reference surfaces 31R are located at equal distances from the turbine central axis, and all of the second radial reference surfaces 21R are also located at equal distances from the turbine central axis. Therefore, when adjustment is made such that the positional relations between the first radial reference surfaces 31R and the second radial reference surfaces 21R are equal at three positions or more, the centers of the first casing and the second casing can be made to geometrically coincide with each other. Thus, according to the present embodiment, a dedicated alignment jig is not needed for the work of the axial alignment of the first casing and the second casing. In addition, since the work is easy, a work time of the axial alignment of the first casing and the second casing can be shortened, and thus a time of the piece-part assembly of the turbine casing can be shortened.

(2) Selecting specific positions of unprocessed flanges as the first radial reference surfaces 31R and the second radial reference surfaces 21R is conceivable in theory. However, in this case, in addition to highly accurate perfect circles of the flanges, a very strict centering accuracy with respect to the outside diameter of the flanges is required when the inside diameter of the first casing and the second casing is processed.

Accordingly, in the present embodiment, the flange peripheral portions of the first casing and the second casing are provided with the slits 31*x* and 21*x*, and inner wall surfaces of the slits 31*x* and 21*x* are set as the first radial reference surfaces 31R and the second radial reference surfaces 21R. The slits 31*x* and 21*x* can be machined in the same setup as inside diameter processing by using a machining center or the like at the same time as the inside diameter processing of the first casing and the second casing, for example. A distance between each first radial reference surface 31R and the turbine central axis can be thereby made uniform with high accuracy. Similarly, a distance between each second radial reference surface 21R and the turbine central axis can also be made uniform with high accuracy.

Whereas a high accuracy of distance of the first radial reference surface 31R and the second radial reference surface 21R from the turbine central axis is required of the slits 31*x* and 21*x*, the functions of the slits 31*x* and 21*x* are not affected even when the slits 31*x* and 21*x* are slightly shifted in position along the first radial reference surface 31R and the second radial reference surface 21R.

However, as long as the above-described essential effect (1) is obtained, the slits 31*x* and 21*x* do not necessarily need to be provided to form the first radial reference surface 31R and the second radial reference surface 21R. For example, protruding portions are formed in advance at parts where the first radial reference surface 31R and the second radial reference surface 21R are intended to be formed on the peripheral surfaces of the flanges 31*v* and 21*v* of the first casing and the second casing. Then, a mode is conceivable in which the first radial reference surface 31R and the second radial reference surface 21R are formed by grinding down end surfaces of the protruding portions by machining. In this case, the first radial reference surface 31R and the second radial reference surface 21R are located more distant from the turbine central axis than the peripheral surfaces of the flanges 31*v* and 21*v*.

(3) As described above, the first roll reference surface 31C and the second roll reference surface 21C are provided whose circumferential positions coincide with each other when the circumferential positions of the first casing and the second casing adjacent to each other in the axial direction are made to coincide with each other. Hence, at the time of the piece-part assembly of the turbine casing, the relative circumferential positions of the first casing and the second casing can be made to coincide with each other by making the positions of the first roll reference surface 31C and the second roll reference surface 21C coincide with each other. Hence, according to the present embodiment, a dedicated alignment jig is not needed when the first casing and the second casing are aligned with each other in the circumferential direction. In addition, since the work is easy, a work time of the alignment in the circumferential direction of the first casing and the second casing can be shortened, and thus the time of the piece-part assembly of the turbine casing can be shortened.

(4) In the present embodiment, the lower half casings 31L and 21L of the first casing and the second casing are provided with the notches 31*y* and 21*y* opposed to the upper half casings 31U and 21U. Then, the end surfaces of the flanges 31*h*1 and 21*h*1 of the upper half casings 31U and 21U, which face these notches 31*y* and 21*y*, are set as the first roll reference surface 31C and the second roll reference surface 21C. An accuracy of reference positions can be secured easily by setting the end surfaces as the roll reference surfaces.

In addition, since the notches 31*y* and 21*y* are provided, a fitting, a scale, or the like having a flat surface, such as the contact fitting M in FIG. 4, can be made to abut against the roll reference surfaces, as described earlier. It consequently becomes easy to measure the step between the first roll reference surface 31C and the second roll reference surface 21C, that is, an amount of displacement between the circumferential positions of the first casing and the second casing. This also contributes to facilitating the work of the angular alignment of the first casing and the second casing.

However, boundaries between the upper half casings 31U and 21U and the lower half casings 31L and 21L can be visually recognized even without the notches 31*y* and 21*y*. Therefore, the notches 31*y* and 21*y* are not necessarily needed in adopting the opposed surfaces of the upper half casings 31U and 21U and the lower half casings 31L and 21L as a reference.

In addition, when positional accuracy of the first roll reference surface 31C and the second roll reference surface 21C can be secured, the opposed end surfaces of the upper half casing and the lower half casing do not necessarily need to be set as the roll reference surfaces. For example, when processing positions in the circumferential direction of surfaces facing the circumferential direction (for example, surfaces N1 and N2 in FIG. 3 and FIG. 5) among the inner wall surfaces of the slits 31*x* and 21*x* can be aligned with each other with high accuracy, these surfaces can also be used as the roll reference surfaces.

(5) In addition, in order to fix the relative positions of the first casing and the second casing, the first casing is provided with the knock hole 42, and the knock pin 43 is erected in the knock hole 42, while the second casing is provided with the through hole 41 having a dimensional margin with respect to the knock pin 43. Hence, even when the centers of the through hole 41 and the knock hole 42 are slightly displaced from each other after completion of the axial alignment and the angular alignment of the first casing and the second casing, the knock pin 43 can be easily driven into the knock hole 42 via the through hole 41. In addition, there is a clearance between the knock pin 43 and the through hole 41, and at a point in time that the knock pin 43 is driven in, the knock pin 43 and the second casing are not in fixed relation. However, the bush 44 is fitted to the knock pin 43, and the through hole 41 and the bush 44 are welded to each other. Consequently, the knock pin 43 is fixed by the bush 44 and the welding portion 45, and the first casing and the second casing can be fixed to each other in a state in which the first casing and the second casing are already aligned with each other.

In general, the flanges of the first casing and the second casing may be subjected to common hole machining after alignment work, and the first casing and the second casing after the alignment may be fixed to each other by driving a knock pin into the common hole. In this case, the first casing and the second casing need to be transferred to a machine tool while the first casing and the second casing are maintained in a stacked state after the alignment, and the common hole machining requires a number of man-hours.

On the other hand, in the present embodiment, as described above, the inside diameter of the through hole 41 is set at a dimension having a margin with respect to the outside diameter of the knock pin 43. Therefore, even when the centers of the through hole 41 and the knock hole 42 are slightly displaced from each other, the knock pin 43 can be driven into the knock hole 42, and the first casing and the second casing can be fixed by covering the knock pin 43 with the bush 44 and welding the bush 44. Thus, a strict positional accuracy is not required of the through hole 41 and the knock hole 42. The through hole 41 and the knock hole 42 can therefore be made in advance before alignment of the first casing and the second casing. Hence, after completion of the alignment work, the first casing and the second casing can be fixed to each other on the spot, and the first casing and the second casing do not need to be transferred to a machine tool for common hole machining. This also contributes to shortening the step of the piece-part assembly of the turbine casing.

DESCRIPTION OF REFERENCE NUMERALS

21: Combustor casing (second casing)
21C: Second roll reference surface
21L: Lower half casing
21R: Second radial reference surface
21U: Upper half casing
21*v*: Flange
21*x*: Slit
21*y*: Notch
31: Turbine casing (first casing)
31C: First roll reference surface
31L: Lower half casing
31R: First radial reference surface
31U: Upper half casing
31*v*: Flange
31*x*: Slit
31*y*: Notch
41: Through hole
43: Knock pin
44: Bush
dR: Step (positional relation between the first radial reference surface and the second radial reference surface)
R1: distance between the first radial reference surface and a turbine central axis
R2: Distance between the second radial reference surface and the turbine central axis

What is claimed is:

1. A turbine casing divided in an axial direction into a first casing and a second casing coupled to each other by flanges of the first casing and the second casing, the first casing and the second casing each being divided into two parts as viewed from the axial direction, the two parts being an upper half casing and a lower half casing, the turbine casing having three or more sets of a first radial reference surface and a second radial reference surface in a circumferential direction, the first radial reference surface being disposed in a flange peripheral portion of the first casing, the second radial reference surface being disposed in a flange peripheral portion of the second casing, each first radial reference surface being located at an equal distance from a turbine central axis, each second radial reference surface being located at an equal distance from the turbine central axis, positional relation between the first radial reference surface and the second radial reference surface being equal in each set.

2. The turbine casing according to claim 1, wherein the first radial reference surface and the second radial reference surface are inner wall surfaces of slits arranged in the flange peripheral portions of the first casing and the second casing, and are surfaces parallel with the turbine central axis and facing outward in a radial direction.

3. The turbine casing according to claim 1, wherein the turbine casing has a first roll reference surface disposed in the flange peripheral portion of the first casing, and a second roll reference surface disposed in the flange peripheral portion of the second casing, and circumferential positions of the first roll reference surface and the second roll reference surface coincide with each other.

4. The turbine casing according to claim 3, wherein the first casing and the second casing are each provided with a notch that is disposed on one side of the upper half casing and the lower half casing so as to face another side, and is faced by an opposed surface on the other side, the opposed surface being opposed to the one side, and the opposed surfaces facing the notches constitute the first roll reference surface and the second roll reference surface.

5. The turbine casing according to claim 1, comprising:

a through hole disposed in the flange of the second casing so as to be parallel with the turbine central axis;

a knock pin inserted into the flange of the first casing through the through hole; and a bush fitted to the knock pin within the through hole, fixed to the flange of the second casing by welding, and configured to fill a clearance between the knock pin and the through hole.

6. A gas turbine comprising the turbine casing of claim 1.

7. An aligning method for a first casing and a second casing of a turbine casing divided in an axial direction into the first casing and the second casing coupled to each other by flanges of the first casing and the second casing, the first casing and the second casing each being divided into two parts as viewed from the axial direction, the two parts being an upper half casing and a lower half casing, the aligning method comprising:

forming the first casing and the second casing such that the first casing and the second casing have three or more sets of a first radial reference surface and a second radial reference surface in a circumferential direction, the first radial reference surface being disposed in a flange peripheral portion of the first casing, the second radial reference surface being disposed in a flange peripheral portion of the second casing, each first radial reference surface is located at an equal distance from a turbine central axis, and each second radial reference surface is located at an equal distance from the turbine central axis;

placing the second casing on the first casing such that the flanges of the first casing and the second casing face each other in a posture in which the turbine central axis is oriented vertically; and adjusting a position of the second casing with respect to the first casing such that positional relation between the first radial reference surface and the second radial reference surface is equal in each set.

8. The aligning method according to claim 7, wherein a first roll reference surface is provided in the flange peripheral portion of the first casing, and a second roll reference surface is provided in the flange peripheral portion of the second casing, and when the position of the second casing with respect to the first casing is adjusted, circumferential positions of the first roll reference surface and the second roll reference surface are made to coincide with each other.

* * * * *